United States Patent [19]

DeLille et al.

[11] 4,027,144

[45] May 31, 1977

[54] MAGNETIC RETURN MECHANISM

[75] Inventors: Richard A. DeLille, East Moline, Ill.; William A. Curnan, Eldridge, Iowa; Gentiel M. DeGryse, East Moline, Ill.

[73] Assignee: Gulf & Western Industries, Inc., New York, N.Y.

[22] Filed: Oct. 28, 1975

[21] Appl. No.: 625,833

Related U.S. Application Data

[62] Division of Ser. No. 546,512, Feb. 3, 1975, Pat. No. 4,005,819.

[52] U.S. Cl. ..... 235/144 ME; 335/229; 235/104; 235/91 M

[51] Int. Cl.[2] ..... G06C 15/42

[58] Field of Search ..... 235/144 ME, 144 EA, 235/144 E, 144 R, 103, 104, 132 R, 132 A, 132 E; 58/125 C; 335/229, 238

[56] References Cited

UNITED STATES PATENTS

| | | | |
|---|---|---|---|
| 3,112,069 | 11/1963 | Truesdell et al. | 235/144 ME |
| 3,311,299 | 3/1967 | Stautmeister | 235/144 ME |
| 3,584,202 | 6/1971 | Kline | 58/125 C |
| 3,885,136 | 5/1976 | Erickson | 235/144 ME |

*Primary Examiner*—Robert K. Schaefer
*Assistant Examiner*—Vit W. Miska
*Attorney, Agent, or Firm*—Meyer, Tilberry & Body

[57] ABSTRACT

An improved magnetic return mechanism, especially useful in timing devices of the type including a motor means for driving a member at a given rotational velocity about a given axis and from a selected angular position, means for indicating when the member has been driven a given angular amount corresponding to a cycle time, means for releasing the member for free rotation about the given axis back to the selected angular position, and return means for rotating the member from a position angularly spaced from the selected position to the selected position. This type of return means includes a first set of permanent magnets, means for supporting the first set of magnets on the member, a second set of permanent magnets, means for supporting the second set of magnets in a generally fixed position to create a magnetic return force on the first set of magnets and a magnetic reaction force on the second set of magnets, wherein the forces combine to return magnetically the member to the selected position when the member is spaced from the selected position and is free to rotate. The improvement in this type of device includes a shifting means for allowing a preselected amount of movement of at least one of the magnets in the first and second set of magnets in response to one of the aforementioned magnetic forces, this allowed movement is generally arcuate of the given axis and is with respect to the support means of the magnet allowed to move.

33 Claims, 40 Drawing Figures

FIG. 4B
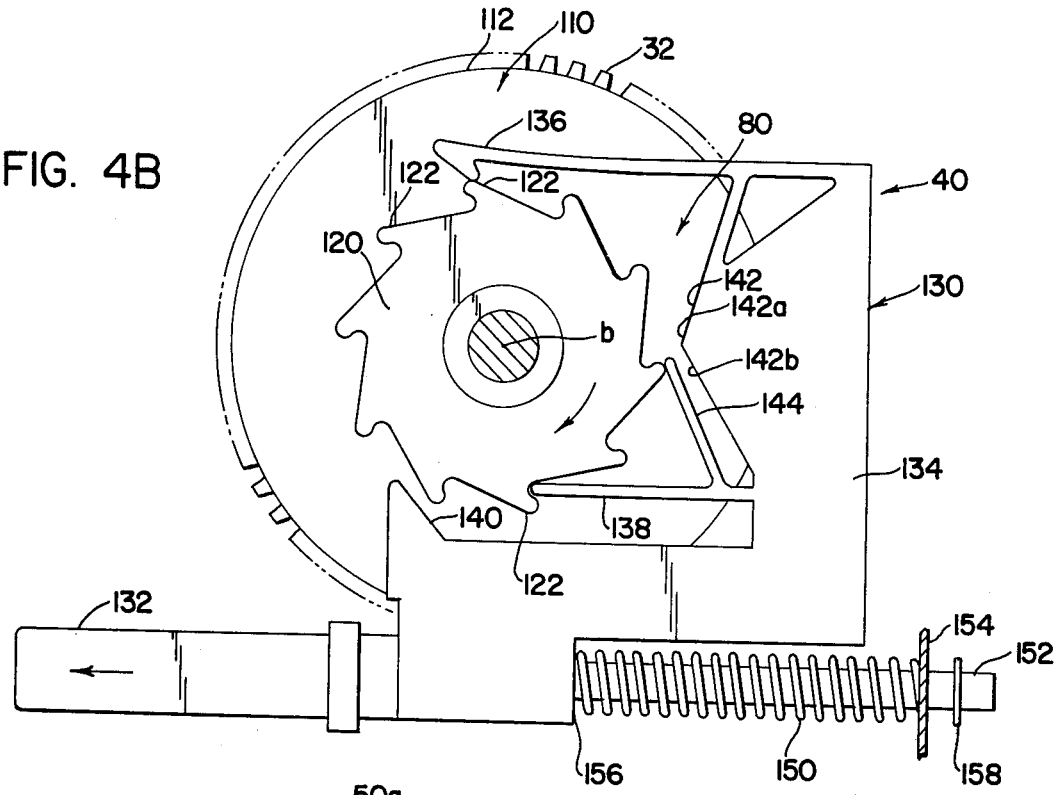
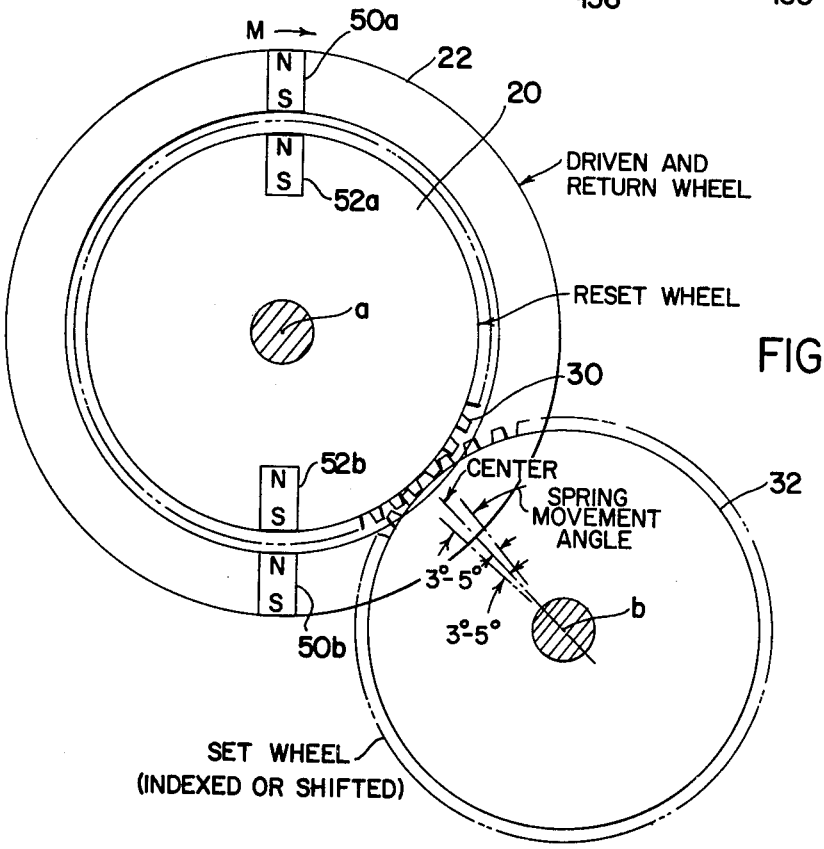
FIG. 5

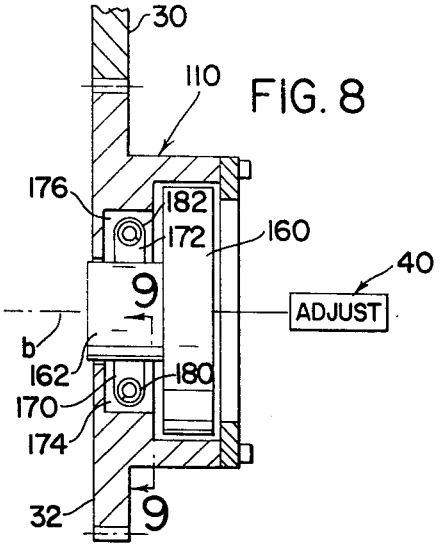
FIG. 8
FIG. 9
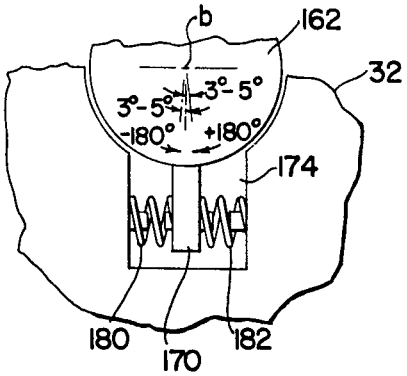
FIG. 9A
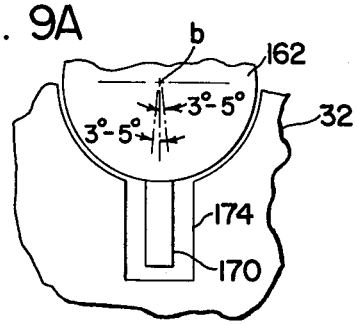
FIG. 9B
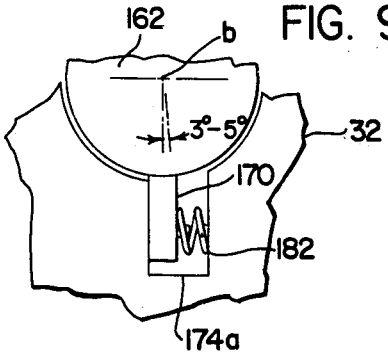
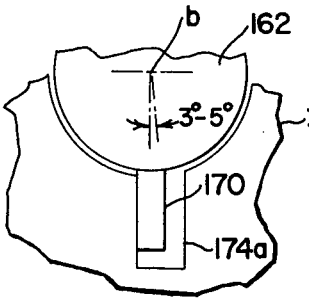
FIG. 9C
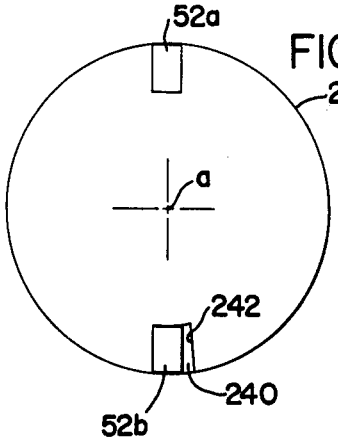
FIG. 16

FIG. 10
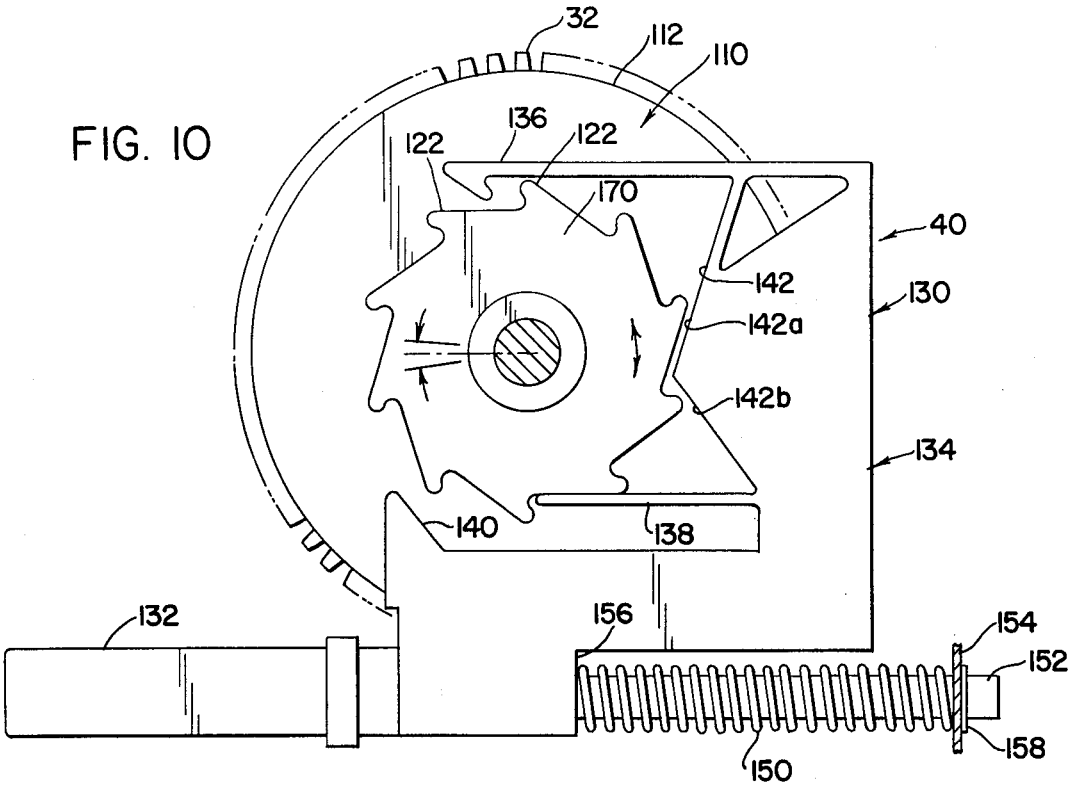
FIG. 11
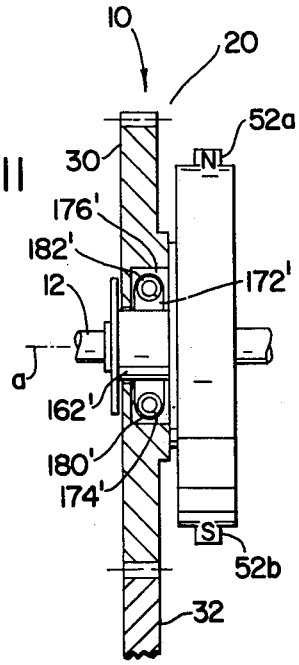
FIG. 17
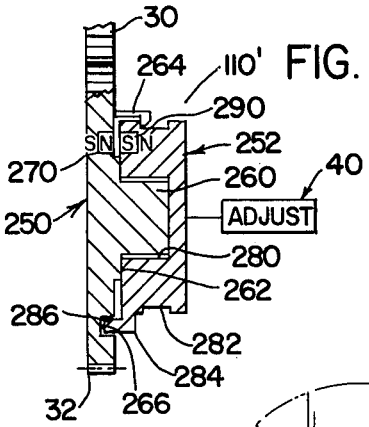
FIG. 17A
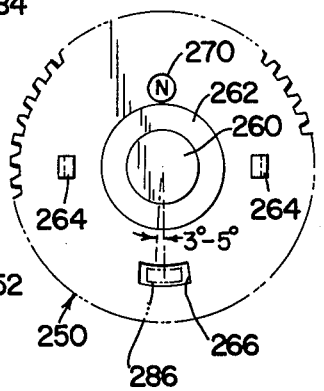
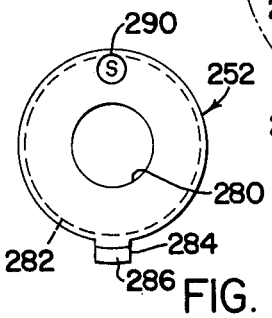
FIG. 17B

MAGNETIC RETURN MECHANISM

This is a division, of application Ser. No. 546,512 filed Feb. 3, 1975, now U.S. Pat. No. 4,005,819.

This invention relates to the art of magnetic return mechanisms and more particularly to a magnetic return mechanism useful in a reset timer.

The invention is particularly applicable for improving the operation of a magnetic return mechanism in a reset timer and will be described with particular reference thereto; however, it is appreciated that the invention is much broader and may be used as an improved magnetic return mechanism for various types of devices wherein one rotational member is to be returned from a variable angular position to a fixed angular position when it is free to rotate.

PRIOR APPLICATIONS INCORPORATED BY REFERENCE

Prior application Ser. No. 445,137, now U.S. Pat. No. 3,885,136, filed Feb. 25, 1974, and prior application Ser. No. 511,051, now U.S. Pat. No. 3,993,895, filed Oct. 1, 1974, are assigned to the same assignee as the present application and are incorporated by reference herein. The first of the above-identified prior applications illustrates a reset timer having a magnetic return mechanism, and the second of the prior applications discloses an improvement in the magnetic return mechanism for such a reset timer. The present application pertains to a further improvement in this type of return mechanism, which improvement can be used in various types of mechanisms using a reset concept.

BACKGROUND OF INVENTION

For some time, reset timers have been used in industrial applications for timing various process cycles and for other related timing functions. For the most part, these reset timers have included a series of wheels which are preset to a given timing cycle. During the timing operation, a synchronous motor rotates the least significant wheel until it reaches zero. Thereafter, the next significant wheel is decremented by one and the least significant wheel again is rotated to zero. This process is continued until all wheels reach a zero setting, which indicates the end of a preselected time controlled by the speed of the synchronous motor. After the timing cycle has expired, the wheels are released to rotate and are returned to positions defining the next timing cycle. Thereafter, the timing operation is repeated. This type of reset timer provides a very effective, inexpensive mechanical timer for industrial use. In the past one of the basic difficulties with this type of reset timer related to the resetting function. After the timing cycle, each of the wheels had to be reset to a precise, preselected position about a given support axis. Since the wheels were rotated more than a single cycle in most instances, the resetting function could not be a simple return mechanism. The return mechanism had to allow rotation of the wheel through many revolutions and then return the wheel to a preselected angular position. This presents substantial difficulty in designing a return mechanism which would operate accurately over many cycles, such as one million or more cycles in a normal life of a timer. A camming mechanism was initially adopted for the return function. This camming mechanism was subjected to wear and had at least one somewhat dead spot in the return operation. To overcome this difficulty, an improved magnetic return mechanism was invented and described in prior application Ser. No. 445,137, filed Feb. 25, 1974. By utilizing a magnetic return mechanism, each of the various reset wheels could rotate an infinite number of times and still return to a preselected position when released after the timing cycle. This was a substantial improvement in the reset timing art and has proven quite satisfactory. To improve the accuracy of a magnetic reset mechanism, a ring type of permanent magnetic system for returning the wheels to a preselected position was invented and is described in prior application Ser. No. 511,051, filed Oct. 1, 1974. This prior improved magnetic reset mechanism was well adapted for a reset timer and provided a positive stop at the predetermined reset position for each of the various reset wheels. In addition, a mechanical braking arrangement is disclosed in this prior application. This improvement in a magnetic reset mechanism, especially adapted for reset timers, has still further improved the reset timing function for a reset timer of the type described above. In each of the two magnetic reset mechanisms described in the prior applications, there is a reduced magnetically induced returning torque at the 180° displacement position. Thus, the present application relates to still further improvement in a reset timer having a magnetic reset mechanism which eliminates, as a practical matter, the theoretical dead spot of a magnetic return mechanism in a reset timer or similar device.

STATEMENT OF INVENTION

The present invention relates to an improvement in a magnetic reset mechanism of the type used in reset timers, which improvement further increases the accuracy and dependability of the magnetic reset mechanism. In accordance with the invention, there is provided an improvement in a device for rotating a member about a given axis to a selected angular position when the member is free to rotate from a position angularly spaced from the selected position. This device includes a first set of permanent magnets, means for supporting the first set of permanent magnets on the member, a second set of permanent magnets, means for supporting the second set of permanent magnets in a generally fixed position to create a magnetic return force on the first set of magnets and a magnetic reaction force on the second set of magnets, these forces combine to return magnetically the member to the selected position when the member is spaced from the selected position and is free to rotate. The improvement of this device is a shifting means for allowing a preselected amount of movement of at least one of the magnets in the first and second set of magnets in response to one of the aforementioned magnetic forces, this allowed movement is generally arcuate of the given axis and is with respect to the supporting means of the magnet or magnets allowed to move. The supporting means for the second set of magnets may be spaced from the second set of permanent magnets and provide the supporting function through one or more intermediate elements.

In accordance with another aspect of the present invention, the shifting means includes a biasing means for resisting the preselected amount of movement. This provides a biased centering of the shifting magnet and also a shock absorbing feature when the magnet systems are used for resetting the member to the selected position. The biasing means is preferably a spring mechanism; however, a magnetic centering and biasing mechanism can be used.

The shifting means and the biased centering of the shifting means may be provided at various positions in the reset timing device. In accordance with one aspect of the invention, the shifting means is provided in a device which is used to change the set position of the second set of permanent magnets for changing the reset position, or selected position of the member. In this manner, the timing cycle of a timer can be changed and the biased shifting means can be provided in the mechanism for changing the preselected timing cycle.

In accordance with another aspect of the present invention, the amount of movement of the movable magnet or magnets is at least about 3° in at least one direction with respect to the axis of the rotatable magnet and in the general range of 3°–5° in at least one direction.

In accordance with another aspect of the invention, the movement of the movable magnet or magnets is in two directions with respect to the generally fixed position of the second set of permanent magnets.

The primary object of the present invention is the provision of a magnetic return mechanism for rotating a member to a selected position from a position angularly spaced from the selected position when the member is free to rotate, which magnetic return mechanism reduces the tendency to have a dead spot at the 180° displacement from the selected position.

Yet another object of the present invention is the provision of a magnetic return mechanism of the type described above, which mechanism is not substantially more expensive than prior magnetic return mechanisms and is more positive and dependable in operation.

Still a further object of the present invention is the provision of a magnetic return mechanism of the type described above, which mechanism includes a spring shock absorbing function at the reset, selected position to dampen oscillations when the member is returned to its selected position. This tends to reduce the resetting time.

Still a further object of the present invention is the provision of a magnetic return mechanism of the type described above, which mechanism uses a spring or auxiliary magnetic force to assist the magnetic return forces at least at the 180° displacement position.

Yet another object of the present invention is the provision of a magnetic return mechanism of the type described above, which mechanism allows shifting of at least one magnet in the magnetic return system under the influence of either the return magnetic forces or the reaction magnetic forces created between two magnetic systems used in the magnetic returning operation. By allowing movement of at least one magnet, a snap action is provided at least at the 180° displacement position for effectively eliminating the magnetic dead spot of the magnetic return mechanism.

BRIEF DESCRIPTION OF DRAWINGS

The above objects and advantages, together with other objects and advantages, will become apparent from a description of the preferred embodiment of the present invention taken together with the accompanying drawings, in which:

FIGS. 4A, 4B are views similar to FIG. 4 showing various positions of the preferred embodiment of the present invention;

FIG. 5 is a schematic view illustrating operating characteristics of the preferred embodiment of the present invention;

FIG. 8 is a partially cross-sectioned, schematic view illustrating a further modification of the preferred embodiment of the present invention;

FIG. 9 is an enlarged cross-sectioned view taken generally along line 9—9 of FIG. 8;

FIGS. 9A–9C are schematic views showing modifications of the structure illustrated in FIG. 9;

FIG. 10 is a view similar to FIG. 4 showing schematically a further aspect of the present invention and an arrangement for providing at least a partial improvement obtained by the preferred embodiment of the present invention;

FIG. 11 is a partial cross-sectional view showing still a further modification of the present invention similar to the structure shown in FIGS. 8 and 9;

FIG. 16 is a schematic view illustrating another embodiment of the invention;

FIG. 17 is a partial cross-sectional view illustrating still a further modification of the preferred embodiment of the invention;

FIG. 17A is a schematic view of one component using the embodiment illustrated in FiG. 17; and, FIG. 17B is a schematic view similar to FIG. 17A joining the other component of the modification illustrated schematically in FIG. 17.

DESCRIPTION OF THE PREFERRED EMBODIMENT

Figure 1:
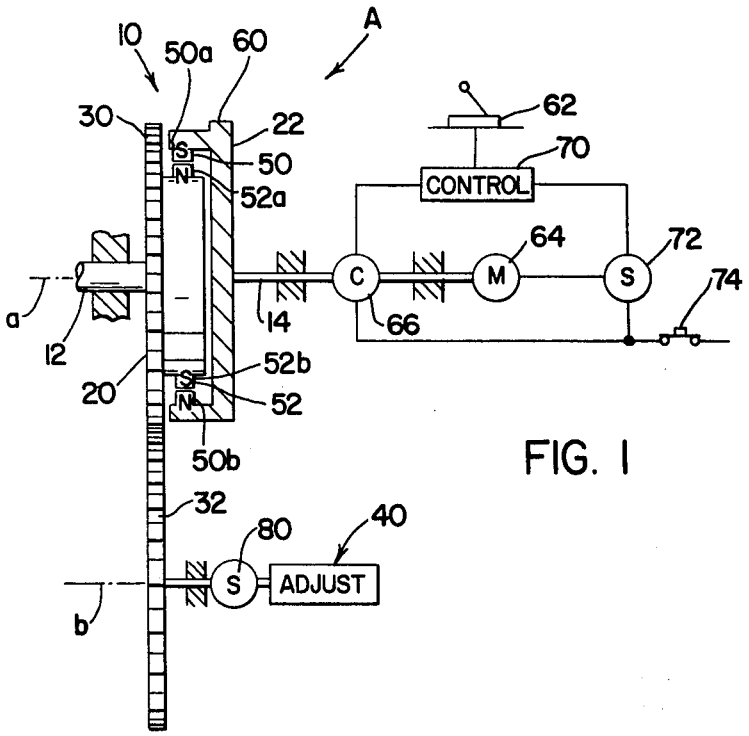
FIG. 1 is a schematic drawing illustrating a simplified reset timer utilizing the preferred embodiment of the invention.
Figure 2:
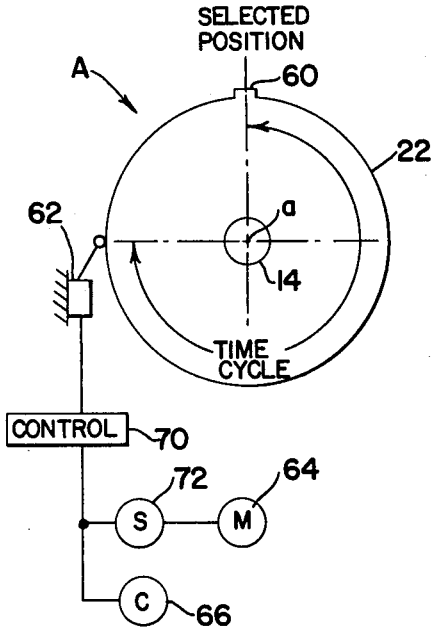
FIG. 2 is a further schematic view of the mechanism illustrated in FIG. 1, showing how a timing function can be created.

Referring now to the drawings, wherein the showings are for the purpose of illustrating the preferred embodiment of the invention and certain modifications thereof, and not for the purpose of limiting same, FIGS. 1 and 2 schematically illustrate the environment and certain aspects of the preferred embodiment of the present invention. A reset timer A is schematically illustrated as including a number wheel 10 rotatably mounted on a given axis a by shafts 12, 14. Only one support shaft is used in the preferred embodiment. Subwheels 20, 22 combine to form number wheel 10. Subwheel 20 is a reset wheel which may be adjusted to change the reset position of number wheel 10, and subwheel 22 is a driven and return wheel which is driven around axis *a* during a timing cycle and is released to return to a selected position after the timing cycle. A first gear 30 is part of subwheel 20 and a second gear 32 is meshed with gear 30 and rotatably mounted on axis *b*, which is generally parallel to and spaced from given axis *a*. Schematically illustrated mechanism 40 is used to manually adjust the selected return position of subwheel 22.

Figure 15:
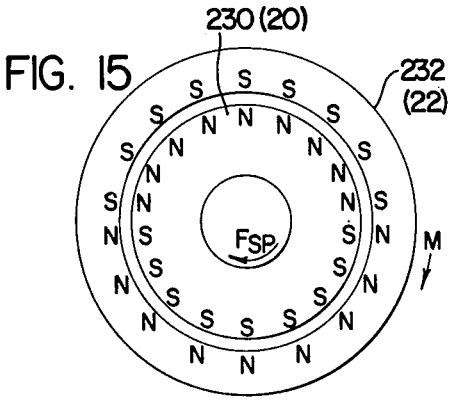
FIG. 15 is a schematic view showing a different type of magnetic system which may be used in the preferred embodiment of the present invention.

To provide the torque and locating mechanism for the return action, there are provided a first set 50 of permanent magnets and a second set 52 of permanent magnets. The first set includes diametrically spaced magnets 50*a*, 50*b*, supported on subwheel 22. The second set 52 includes diametrically opposed magnets 52*a*, 52*b* supported on subwheel 22. As will be explained later the position of magnet set 52 is supported or held by the device for holding gear 32 in a generally fixed position. As will be explained later, if subwheel 22 is stopped at a position spaced from the selected position controlled by the adjusted position of magnet system 52, upon release of subwheel 22, it will return to the adjusted, selected position. Of course, the individual magnets could be ring shaped magnets each extending 180° around an arc concentric with axis *a*. This concept is illustrated in FIG. 15.

To complete the schematic illustration of reset timer A, a cam 60 is supported on subwheel 22 and a cam operated switch 62 is closed by cam 60. A synchronous motor 64 drives subwheel 22 in the clockwise position, as shown in FIG. 2, from the selected position to switch 62 to provide a timing cycle. At that time, a clutch 66 is released by an appropriate control 70, such as a relay, to release motor 64 from subwheel 22. This allows subwheel 22 to return to its selected position, as shown in FIG. 2. Control 70 can also operate a start-stop device 72 for deenergizing motor 64 at the end of a timing cycle. A schematically illustrated switch 74 can start the next cycle which engages clutch 66 and again drives subwheel 22 through a timing cycle.

FIGS. 1 and 2 are schematic representations of a timer using the preferred embodiment of the present invention. When subwheel 22 is released, it returns to the selected position controlled by the position of magnets 52*a*, 52*b*. This position is changed by the adjusting device 40 through first gear 30 secured onto and forming a part of subwheel 20 and second gear 32 which is angularly adjusted by the mechanism 40. In practice, the present invention is used for a reset timer and a plurality of wheels 10 are provided in series, as disclosed in prior applications Ser. No. 445,137, filed Feb. 25, 1974, and Ser. No. 551,051, filed Oct. 1, 1974. When used in this type of device, a plurality of wheels 10 are provided. The least significant wheel is rotated to zero by synchronous motor 64. At that time, the least significant wheel continues to rotate past zero to the digit nine which indexes the next significant wheel 10 by a single digit. When the next significant wheel 10 reaches zero, it then rotates the third significant wheel by a digit. This counting function is continued until all of the wheels are decremented to zero. At that time, a mechanism analogous to switch 62 is operated. This can be done by providing a switch 62 on each wheel and allowing control 70 to be operated only when all switches are operated by a camming arrangement to indicate a zero setting of all number wheels. In addition, a single follower can be provided on each of the number wheels to operate switch 62 when all wheels are in the zero position. All of these concepts, to adapt the single wheel shown in FIGS. 1 and 2 to a multiple wheel reset timer, are well within the skill of the art and are clearly shown in the prior applications incorporated by reference herein.

The present invention relates to a device for use on each of the separate number wheels 10 to improve the accuracy of the returning action from the end of the cycle time to a reset position established by mechanism 40 through gears 30, 32. Mechanism 40 changes the position of gear 32 to change the selected position of subwheel 22. A schematically illustrated spring shift mechanism 80 is positioned between the manually adjustable mechanism 40 and gear 32. This mechanism allows slight movement in either angular direction of gear 32 with respect to the selected set position against a spring bias arrangement. By allowing this slight movement of gear 32, the magnet sets 52 can move slightly in both angular directions during the operation and interaction of the two sets of magnets in returning subwheels 22 to a selected set position. In essence, magnets 52*a*, 52*b* are movable with respect to mechanism 80 which is used to support these magnets in a generally fixed position. The actual movement of magnets 52*a*, 52*b* with respect to the locating or supporting means is in an arcuate path or direction about axis *a*. Details of the preferred embodiment of this concept are set forth below.

Referring now to FIGS. 3, 4, 4A and 4B, the preferred embodiment of the present invention is illustrated. The drive mechanism for subwheel 22 is somewhat different from that illustrated in FIG. 1; however, the same basic functions are obtained. A pinion 90 is driven by synchronous motor 64 to rotate the face wheeling gear 92 about axis *a*, defined by shaft 12. Clutch 66 is in the form of a gear stand including axially spaced gears 94, 96. The clutch is illustrated in its open position to allow subwheel 22 to return to its set position, shown as digit 4. Teeth 98 of subwheel 22 mesh with the teeth of gear 96 to complete the controlled drive from synchronous motor 64 to subwheel 22. Surface 100 on subwheel 22 is provided with numerals 0–9 so that the position of subwheel 22, which is the driven and returned wheel, can be visually observed. Second gear 32 is an integral part of a reset wheel 110, having an outer surface 112 containing numbers corresponding to the numbers on surface 100. During assembly, the wheels 10, 110 are correlated so that the number appearing at the center position of wheel 110 will appear in the center position of wheel 10 when it is reset by the magnetic return mechanism to the selected position.

Figure 4:
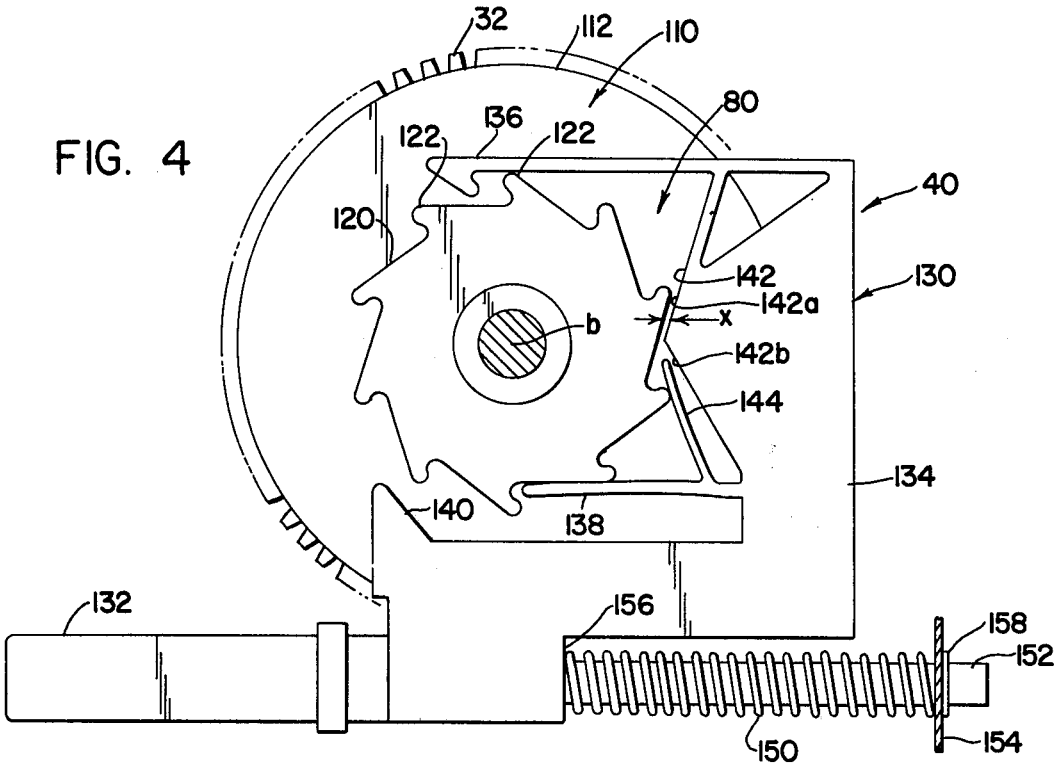
FIG. 4 is a side elevational view taken generally along line 4—4 of FIG. 3 and showing the preferred embodiment of the present invention in one operating position.
Figure 4A:
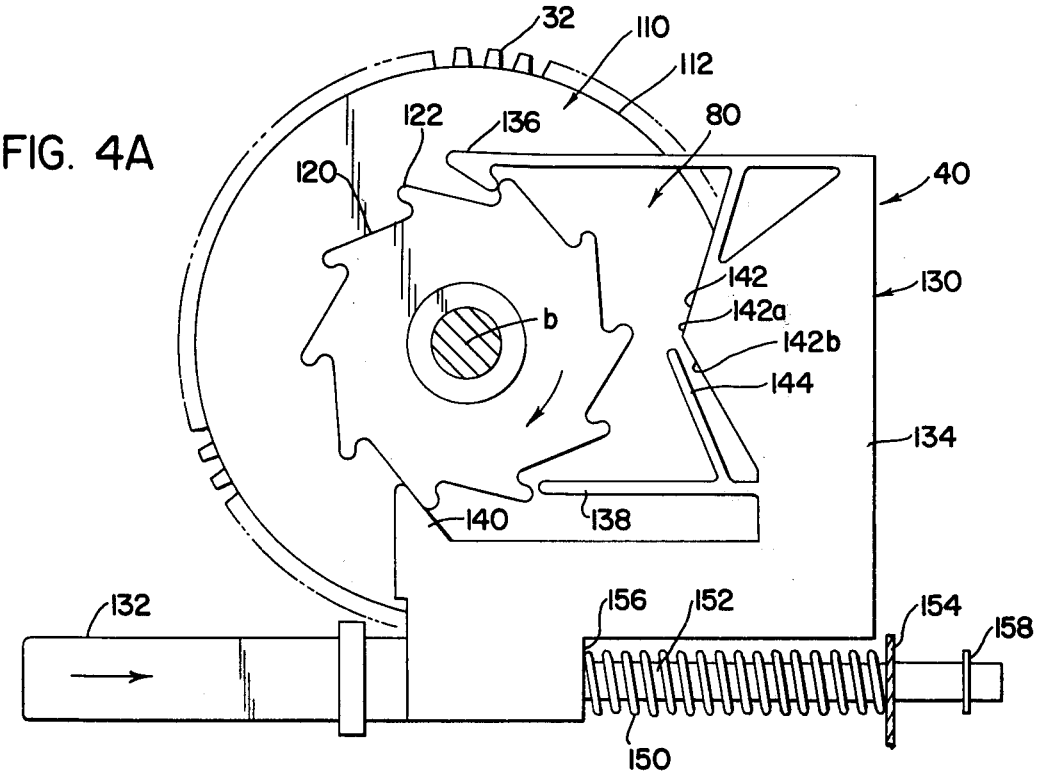

As best shown in FIGS. 4, 4A and 4B, reset wheel 110 has integrally formed thereon an outboard ratchet wheel 120 having a series of teeth 122 corresponding to the ten adjusted positions of reset wheel 110. By indexing wheel 110 by a tooth 122, wheel 110 is rotated through an arc corresponding to a single digit change on wheel 110. To index ratchet wheel 120, there is provided a reciprocally mounted, manually operated position changing mechanism 130 in the form of an integral plastic element including a push button 132, a body portion 134, a resilient pawl 136, a resilient arm 138, a front stop 140 to coact with an appropriate tooth 122, a rearward shoulder 142 having angular protions 142*a*, 142*b*, and a spring biasing arm 144 forming a part of the preferred embodiment of the present invention. To control movement of mechanism 130, a spring 150 encircles a spring rod 152 which extends through an apertured plate 154. Spring 150 is compressed between a shoulder 156 and apertured plate 154. To limit movement of mechanism 130 upon release of push button 132, there is provided a stop 158 which provides a spacing *x* between one tooth 122 and shoulder portion 142*a*, as shown in FIG. 4. This position is held by spring 150.

The adjusted position of mechanism 80 is illustrated in FIG. 4. In this position, the ratchet wheel 120 is held by opposed resilient arm 138 and biasing arm 144. This allows a controlled amount of rotation of wheel 110, and thus gear 32, about axis *b* in response to any forces transmitted by the magnetic mechanism in wheel 10 through gears 30, 32. Thus, gear 32 can shift from its generally fixed position of FIG. 4 against the spring bias of arms 138, 144. This biased shifting is only a slight, controlled amount. This amount limited by shoulder portion 142*a* in the clockwise direction and by shoulder portion 142*b* in the counter clockwise direction. In practice, the resilient arms 138, 144 impose a biasing action of approximately 10 grams at wheel 10. Thus, there is no movement of ratchet wheel 120 until a torque is exerted on gear 32 by a force from gear 30 corresponding to approximately 10 grams in either direction at the magnetic systems. A force of approximately 20 grams in either direction at the magnetic systems will shift ratchet wheel 110 into either its clockwise or counter clockwise spring biased position determined by shoulder portions 142*a*, 142*b*, respectively. Arms 138, 144, thus, provide a centered position by acting upon ratchet wheel 120. This generally fixed, centered position can be changed slightly by magnetic forces created between the magnetic sets 50, 52 and transmitted through gears 30, 32. The distance *x* which is controlled by stop 158 can be changed by changing the position of this stop, which, in practice, is a snap ring supported in a groove on rod 152. Spacing, or distance, *x* is approximately 0.30 inches in practice. This provides approximately a 3.5° shift of wheel 10 toward either side of the generally fixed, centered position determined by resilient arms 138, 144, as shown in FIG. 4. In practice, the allowed amount of shift against the spring biasing elements can be in the general range 3°–5°, in either rotational direction at subwheel 20. When torque is removed from gear 30, gear 32 is released and centered by resilient arms 138, 144. If a force greater than approximately 20 grams is created between the magnet systems, the spring shift mechanism 80, as shown in FIG. 4, will not shift beyond a preselected angular movement controlled by any appropriate means, such as the shoulder portions 142*a*, 142*b*. By providing this controlled shifting of at least approximately 3°, the magnetic systems used to return subwheel 22 to its selected, reset position will not experience a dead center adjacent the 180° displacement position. The operation of the preferred embodiment, as herein described, illustrates the advantage of the spring shifting mechanism 80, as shown in FIG. 4.

Figure 3:
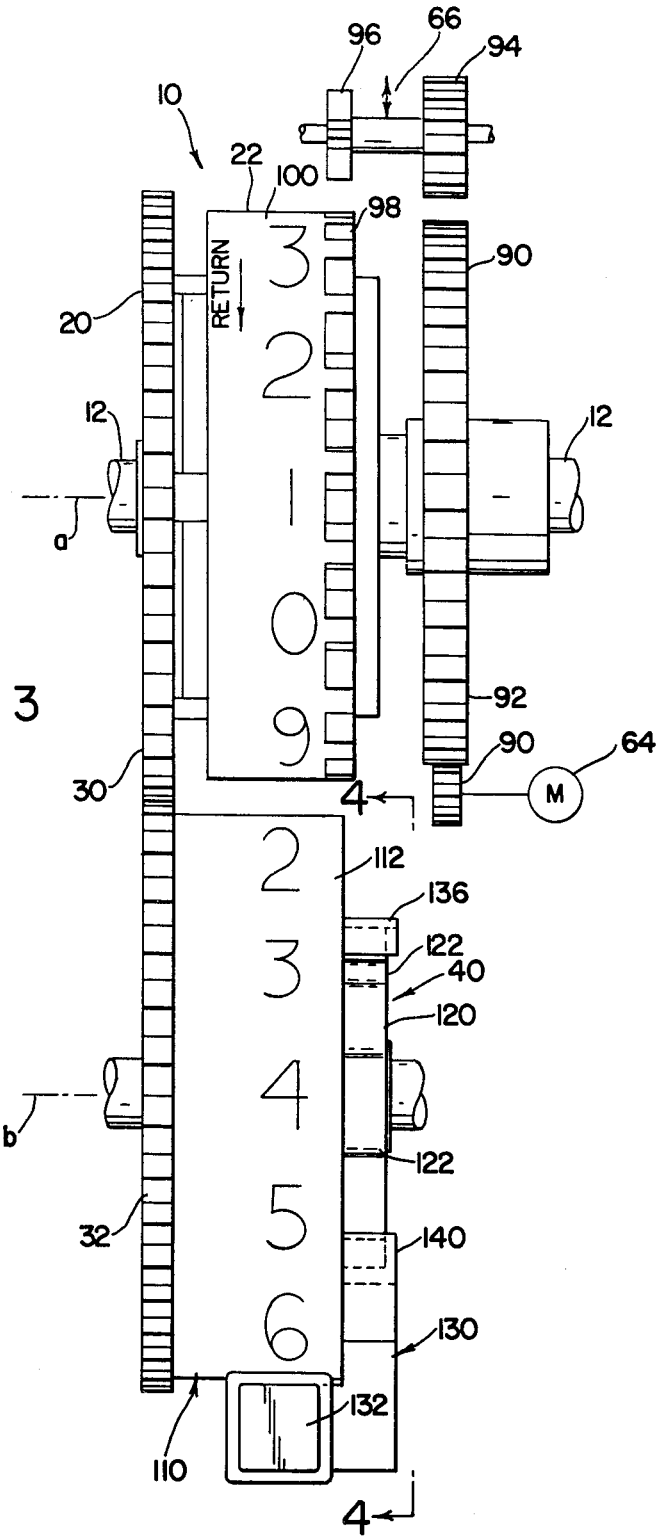
FIG. 3 is an enlarged schematic view showing a dual wheel mechanism for utilizing the preferred embodiment of the present invention.

Referring now to FIG. 4A, the spring shifting and centering mechanism 80 does not affect the operation of the reciprocally mounted, manually operated position changing mechanism 130. When push button 132 is forced inwardly, resilient pawl 136 engages a tooth 122 and rotates reset wheel 110 by a distance limited by stop 140. This is partial shifting of wheel 110. The final shifting of wheel 110 is effected when the push button is released by resilient arm 138 engaging a lower tooth 122, as shown in FIG. 4B. When in this position, the continued travel of mechanism 130 upon release of push button 132 continues the rotation of wheel 110 until it has been indexed a single digit. The final position of mechanism 130 is shown in FIG. 4, wherein arms 138, 144 center wheel 110 to a corresponding, indexed digit and provides a generally fixed position for magnets 52*a*, 52*b*. Repeated depressions of push button 132 incrementally changes the angular position and the centered numeral on wheel 110, as illustrated in FIG. 3. In this manner, mechanism 130 can be used to shift wheel 110 into the proper adjusted position corresponding to a desired timing cycle. By adjusting wheel 110, the selected reset position of subwheel 22 is correspondingly changed.

In accordance with the preferred embodiment of the present invention, the mechanism as so far described differs from the reset mechanism as shown in prior application Ser. No. 445,137, filed Feb. 25, 1974, and Ser. No. 511,051, filed Oct. 1, 1974, by providing a spring centering action for wheel 110. In the prior applications, shoulder 142 engages ratchet wheel 120 to prevent rotation of the ratchet during operation of the reset timer. In accordance with the preferred embodiment of the invention, shoulder 142 is intentionally shifted from the ratchet wheel when push button 132 is in its released position to provide a slight amount of anuglar movement, which controlled angular movement, in the preferred embodiment, is against the biasing action of resilient arms 138, 144. As will be explained later, it is possible to obtain certain advantages of the preferred embodiment of the present invention by providing either a undirectional biasing action or by providing only controlled limited movement without a spring biasing action. These two slight modifications in the preferred embodiment are within the intended scope of the present invention and will be described later in connection with certain modifications of the preferred embodiment as shown in FIGS. 3, 4, 4A and 4B.

OPERATING CHARACTERISTICS OF THE PREFERRED EMBODIMENT

FIG. 5 schematically illustrates the operation of the magnet systems in returning subwheel 22 to a selected position determined by the adjusted generally fixed position of subwheel 20. Magnets 50*a*, 50*b*, 52*a* and 52*b* are schematically illustrated as bar permanent magnets facing each other in the returned, selected position. Of course, magnets could be ring magnets, as shown in FIG. 15, without departing from the intended spirit and scope of the invention. In the position shown in FIG. 5, the magnets are magnetically balanced with opposite poles facing each other in the attracted position. The supporting structure for magnets 52*a*, 52*b* holds these magnets in a generally fixed position and includes, in the preferred embodiment, mechanism 80, gear 32 and gear 30 of subwheel 22. Magnets 52 are movable with respect to a part of mechanism 80 defined by arms 138, 144. The balanced magnet systems of FIG. 5 do not creat any torque on subwheel 20 which can be transmitted through gears 30, 32 to magnet supporting arms 138, 144. Referring now to FIG. 5A, synchronous motor 64 has driven subwheel 22 in an angular direction, indicated by arrow M in FIG. 5, to a position 5° from the selected returned position. This can occur after many revolutions of subwheel 22 and represents the operating characteristics of the magnets when subwheel 22 is in the position represented by FIG. 5A, irrespective of the number of revolutions required to obtain this position. Only the action of magnet 50*a* will be described; however, the same action is occuring at magnet 50*b*. With magnet 50*a* shifted clockwise 5° from magnet 52*a*, there is a high returning force $F_{MR}$ attempting to return magnet 50*a* to the home or reset position. Since the turning force has not yet reached 10 grams of torque, the pulling force $F_{MF}$ has not reached a sufficient level to cause shifting of subwheel 20, allowed by supporting arms 138, 144. If subwheel 22 is released in the position shown in FIG. 5A, magnetic force $F_{MR}$ will return subwheel 22 to the home position.

Figure 5A:
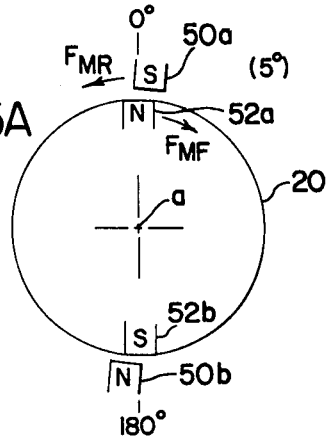
FIGS. 5A–5L are schematic operating views of the basic structure shown in FIG. 5 at various operating positions.
Figure 5B:
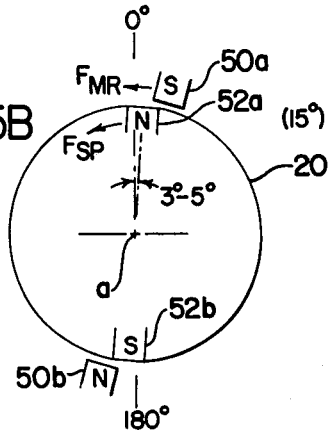

Referring now to FIG. 5B, subwheel 22 has been shifted by synchronous motor 64 to a position 15° clockwise from the home position. In this position, the magnetic force $F_{MR}$ is greater than 10 grams. Thus a corresponding magnetic reaction force pulls gear 32 against the resiliency of arm 144 by an angle controlled by shoulder portion 142*b*, as shown in FIG. 4. Magnetic reaction force as used herein means the magnetic forces exerted on magnets 52*a*, 50*b* by magnets 50*a*, 50*b*, which magnetic forces tend to rotate magnets 52*a*, 52*b* with respect to the structure tending to hold or support the magnets in a generally fixed position. In this shifted position, a spring return force $F_{SP}$ is exerted on subwheel 20; however, this force is not as great as the magnetic reaction or pulling force $F_{MR}$ holding the magnets 52*a*, 52*b* in the clockwise biased position. If subwheel 22 were released in the position shown in FIG. 5B, magnets 50*a*, 52*a* would align themselves in a balanced position and the spring force $F_{SP}$ would shift subwheel 22 to its adjusted or reset position, as shown in FIG. 5L.

Figure 5C:
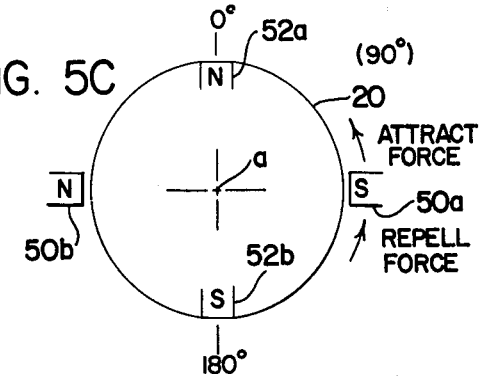

Referring now to FIG. 5C, wherein subwheel 22 has been rotated to a position 90° clockwise from the reset position, the magnetic reaction forces acting between the magnets is not sufficient to hold a clockwise spring biased offset condition, shown in FIG. 5B. Thus, subwheel 20 returns to its centered position. If subwheel 22 were released, magnetic forces between magnet sets 50, 52 would rapidly shift subwheel 22 to its reset position without substantial effect by the spring biasing mechanism 80.

Figure 5D:
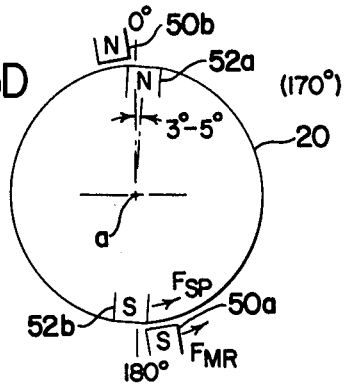

Referring now to FIG. 5D, subwheel 22 is approaching the 180° displacement position and is approximately 10° therefrom. In this 170° clockwise position, the repelling reaction forces between magnet 50*a*, and magnet 52*b* is sufficient to shift subwheel 20 clockwise against the biasing action of arm 144, in a manner shown in FIG. 5B. Thus, subwheel 20 is cocked and a spring force $F_{SP}$ is being exerted in a direction to again center subwheel 20 with respect to the supporting arms 138, 144.

Figure 5E:
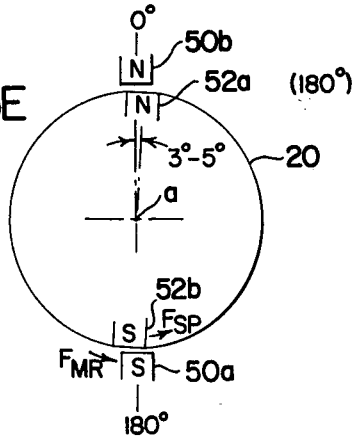
Figure 5F:
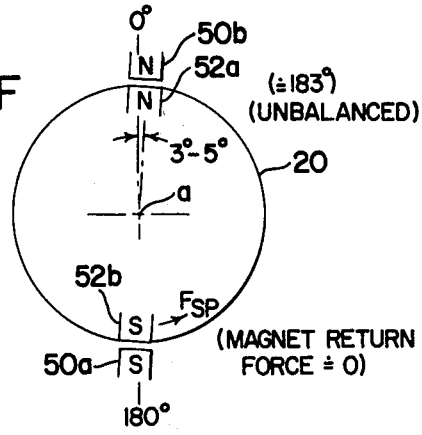
Figure 5G:
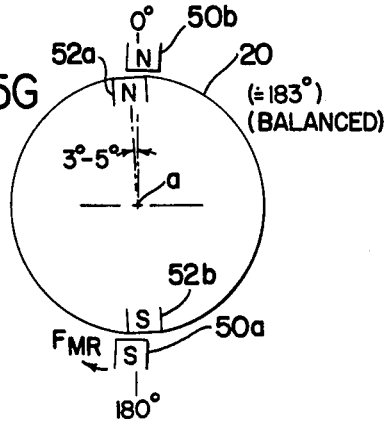

As subwheel 22 continues from the approximately 170° clockwise position, it approaches the 180° position as shown in FIG. 5E. In this position, a sufficiently large magnetic reaction force is retained against magnet 52*b* to hold the spring biased offset against spring force $F_{SP}$. In this position, there is still a magnetic return force $F_{MR}$ attempting to push magnet 50*a* back to the reset position. Since the augular movement of subwheel 20 is limited by shoulder 142*b* of mechanism 80, as shown in FIG. 4, magnet 50*b* can not move beyond the position shown in FIG. 5E. Thus, continued movement in a clockwise direction of subwheel 22 ultimately brings magnet 50*a* into general alignment with magnet 52*b*. This is shown in FIG. 5F. This is a momentary situation and is unstable and cannot be retained. When magnets 50*a*, 52*b* are generally aligned, there is relatively little magnetic force between these magnets to create a torque on subwheel 20. Thus, before this magnetically balanced condition is reached, the 10–20 grams spring force $F_{SP}$ comes into play and snaps subwheel 20 counter clockwise, as is shown in FIG. 5G. Consequently, as subwheel 22 approaches the dead center position of the magnet system, a spring cocking action of mechanism 80 takes over, and the spring force $F_{SP}$ snaps subwheel 20 over dead center into the counter clockwise shifted position. This is a spring biased displaced condition acting against the spring bias of arm 138, as shown in FIG. 4. Thus, as the magnets approach their normal 180° dead center condition, ratchet 120 is snapped from the counter clockwise spring loaded condition to the clockwise spring loaded condition. This corresponds to the clockwise spring loaded position and counter clockwise spring loaded position, respectively, of subwheel 20. If subwheel 22 were released when magnet 50*a* is in the position shown in FIG. 5E, subwheel 22 would return in a counter clockwise direction to the home position. If subwheel 22 were released in the position shown in FIG. 5G, the subwheel would return in a clockwise direction to the home position. Thus, there is a snap action at the 180° position which shifts the returning action for subwheel 22 rapidly between the counter clockwise and the clockwise magnet returning forces. After the snap action has occurred, the return action is primarily a magnetic return. The snap action combined with the normal instability of the magnetic system at the 180° position assures positive magnetic control over subwheel 22, irrespective of its release position.

Figure 5H:
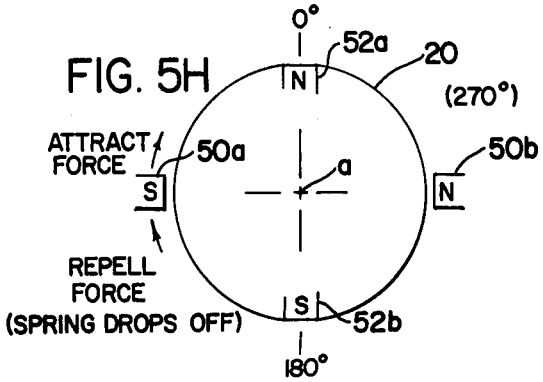
Figure 5I:
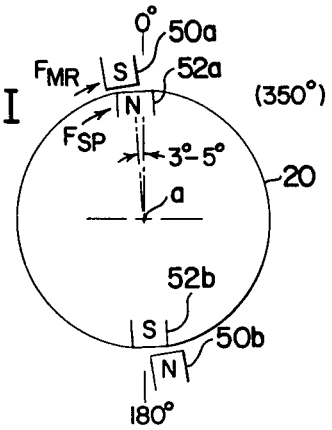
Figure 5J:
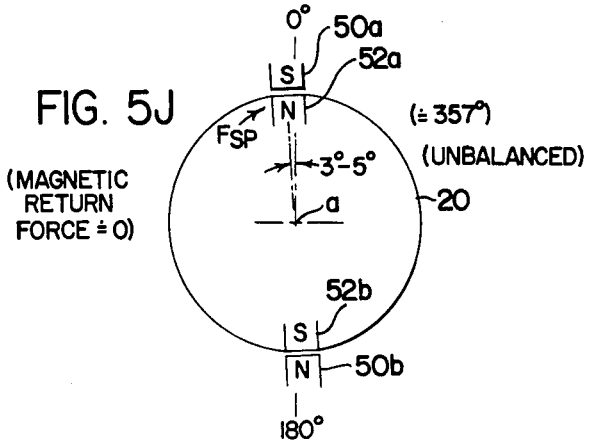
Figure 5K:
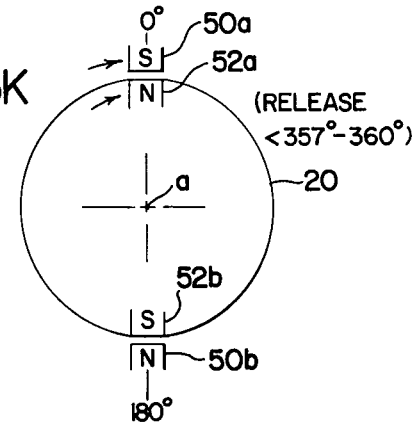
Figure 5L:
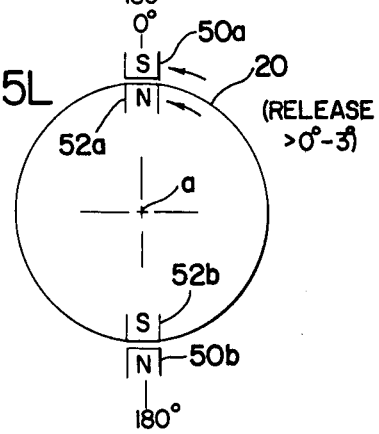

At the 270° clockwise position, as shown in FIG. 5H, the magnetic conditions are similar to those described in connection with FIG. 5C. As subwheel 22 approaches the home, or reset, position in a clockwise direction, as shown in the 350° position of FIG. 5I, the magnetic reaction force between the magnet systems again shifts subwheel 20 against spring action of arm 138. This stores a spring returning force $F_{SP}$ in subwheel 20, as subwheel 22 continues toward the home position. As the two magnet systems become magnetically balanced by the magnets coming together, spring returning force $F_{SP}$ returns the magnets to their home position. This is shown in FIG. 5J. If subwheel 22 were released in the position shown in FIG. 5I or the position shown in FIG. 5J, the two magnets would come together and then move together under spring force $F_{SP}$, as shown in FIG. 5K, to the home position. If subwheel 22 were released at a position slightly spaced in a clockwise direction and beyond about 5°, the two magnets may come together and then be shifted back into the home position by an opposite spring action. This is shown in FIG. 5L. These two actions of the system are not as advantageous as the 180° concept, as shown in FIGS. 5D–5G.

Figure 6:
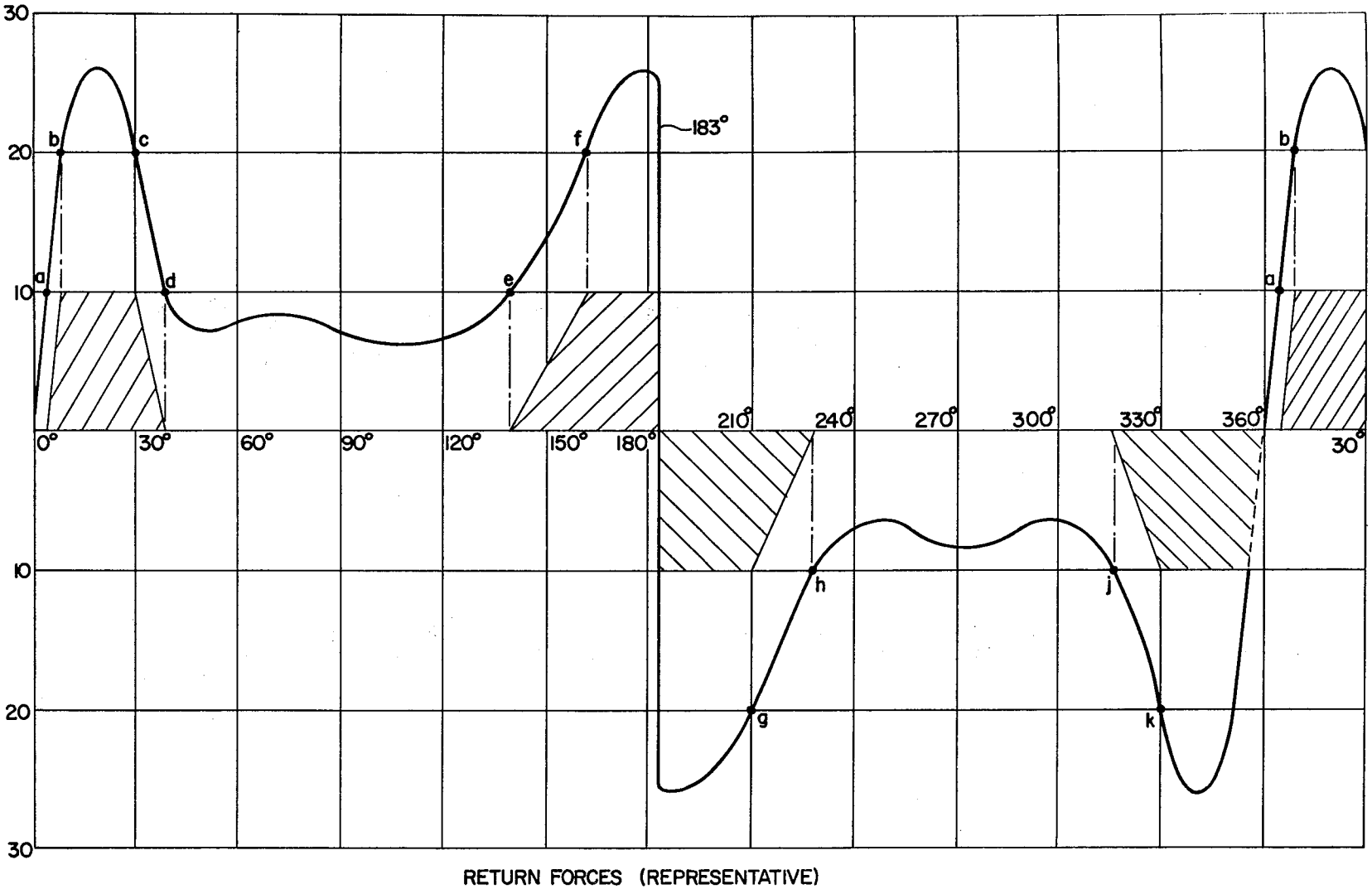
FIG. 6 is a graph schematically illustrating operating characteristics as shown in FIGS. 5A–5L.

The torque curve for the returning force of subwheel 22 is schematically illustrated in the graph of FIG. 6. The cross-sectioned portions represent the condition of the spring return mechanism 80 at various angular positions. It is noted that there is a somewhat instantaneous spring force shift at a position just beyond 180° for the subwheel 22. Thus, in the area adjacent the 180° position, there is always a stored spring force for shifting the subwheel 22 toward its selected reset position. At the end of the curve, the returning force is shown as a dashed line indicating a spring force instead of a magnetic force. This corresponds to the concepts shown in FIGS. 5I–K.

As clearly shown in FIGS, 5A–5L, it is possible to provide the desired magnetic snap action at approximately the 180° position by allowing movement of the magnets on subwheel 20 in only the counter clockwise direction. This will create the snap action of FIG. 5G which does not require movement of magnets 52*a*, 52*b* beyond the centered position. In practice, an offset in both directions is used. This offset is in the general range of 3°–5°. A minimum of approximately 3° is desired at least in the direction to create the snap action adjacent the 180° position, as described in FIGS. 5D–5G.

MODIFICATION OF THE PREFERRED EMBODIMENT

Figure 7:
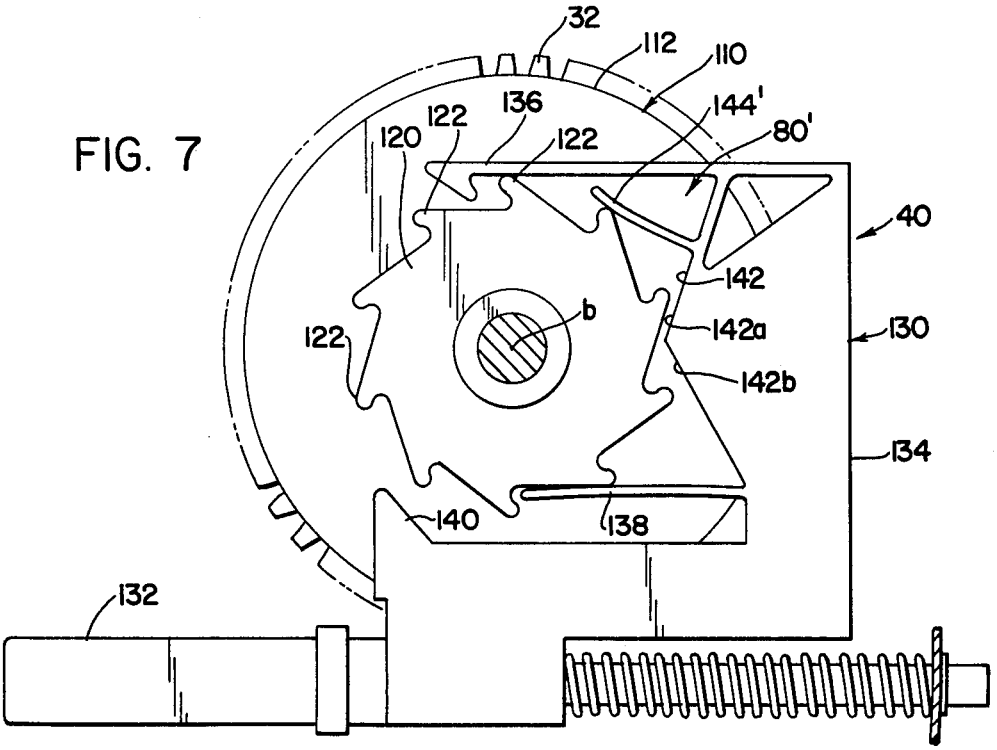
FIG. 7 is a view similar to FIG. 4 showing a modification of the preferred embodiment of the present invention.

Referring now to FIG. 7, resilient arm 144 can be replaced by resilient arm 144' to provide the biasing action on ratchet wheel 120. The operation of this modification of the preferred embodiment of the invention is the same as described in connection with the preferred embodiment shown in FIG. 4. Again, shoulders 142*a*, 142*b* limit the amount of controlled angular movement in response to magnetic reaction forces created by the magnets in subwheels 20, 22.

Referring now to FIGS. 8 and 9, a further modification of the preferred embodiment is illustrated. In this modification, reset wheel 110 is formed in two parts including an inner portion 160 and an outer portion, indicated as gear 32. Inner portion 160 includes a shaft 162 which supports diametrically opposed lugs 170, 172 received in recesses 174, 176, respectively, of gear 32. The inner portion is maintained in a center position by springs 180, 182 on opposite sides of lugs 170, 172. In this schematically illustrated embodiment, the spring action is allowed between the two portions of reset wheel 110. Torque from gear 30 created by the magnetic systems in number wheel 10 compress springs 180, 182 so that the magnetic systems operate substantially in accordance with the preferred embodiment, as shown in FIG. 4. Of course, only a single lug 170 could be used to provide the spring balance concept.

Referring now to FIG. 9A, a further modification is illustrated wherein springs 180, 182 are not used. In this manner, there is no spring return. However, at the 180° position, there will still be a shift in the angular position of the magnets 52*a*, 52*b* carried by subwheel 20 and generally supported by mechanism 80. This shift is a snap action to assure a positive returning action for the magnetic systems. However, this embodiment will not provide accurate return at the home position and may not be acceptable in certain applications of a magnetic return mechanism. For instance, it would not be acceptable for most industrial timers without an appropriate means to assure positive location at the selected reset position. Referring now to FIG. 9B, a further modification of the structure shown in FIG. 9 is illustrated. In this modification, the recess 174*a* is such that controlled movement of magnets 52*a*, 52*b* in only the counter clockwise direction is allowed. This will provide the snapping action adjacent the 180° position without an over center concept used in the preferred embodiment of the invention. The structure of FIG. 9B cna be modified to eliminate the spring 182 to provide a structure somewhat similar to that illustrated in FIG. 9A. This is shown in FIG. 9C. In this concept, a snap action is provided adjacent the 180° displacement position, but movement beyond the centered condition in an opposite direction is prevented. This would correct some of the inaccuracies of the structure shown in FIG. 9A.

Referring now to FIG. 10, still a further modification of the preferred embodiment is illustrated. In this modification the resilient arms 144, 144' are removed from the manually operated position changing mechanism 130. This provides a somewhat floating concept as discussed in connection with FIGS. 9A, 9C. Shoulder portions 142*a*, 142*b* would still limit movement of gear 32. Resilient arm 138, which is used in the indexing system, may exert a spring bias toward a centered position from one direction.

FIG. 11 is a further modification of the preferred embodiment of the invention wherein a structure similar to that shown in FIGS. 8 and 9 is employed at the upper reset wheel 10 by dividing subwheel 20 into two parts, on of which includes gear 30 and the other of which includes the carrying structure for magnets 52*a*, 52*b*. The structure for supporting the magnets in a generally fixed position would then be gear 30 and movement would be allowed with respect to this gear. The operation of this embodiment is the same as that discussed in connection with FIGS. 8 and 9. The numerals used in FIG. 11 correspond to similar numerals used in FIGS. 8 and 9 with the addition of a prime.

Figure 12:
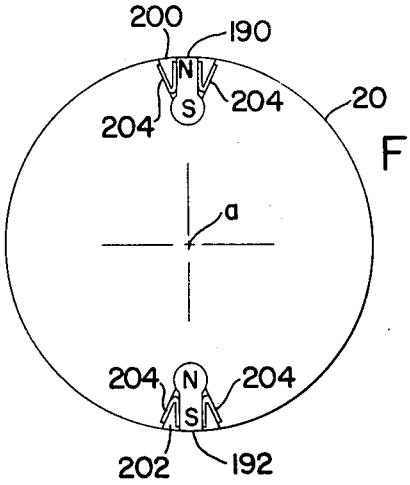
FIG. 12 is a schematic view illustrating yet another modification of the preferred embodiment of the present invention.
Figure 13:
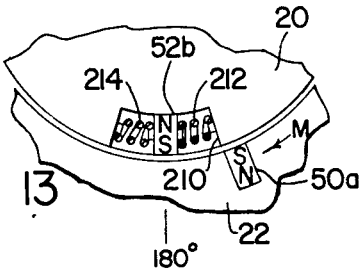
FIG. 13 is a schematic, partial view illustrating an aspect of the preferred embodiment of the present invention and a modification of the preferred embodiment of the present invention.
Figure 13A:
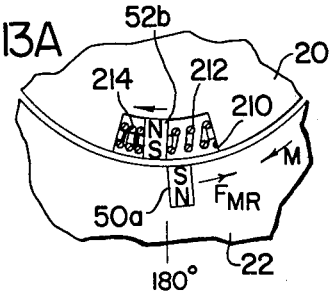
FIGS. 13A and 13B illustrate operating characteristics of the schematically illustrated structure of FIC 13.
Figure 14:
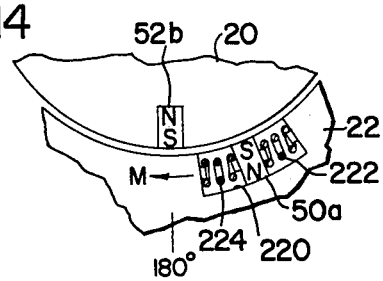
FIG. 14 is a view similar to FIG. 13 illustrating still a further modification of the present invention.
Figure 13B:
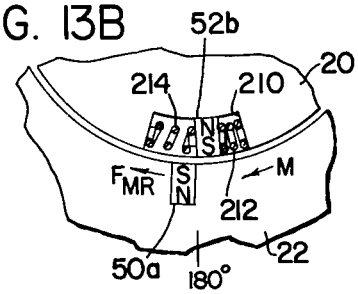
Figure 14A:
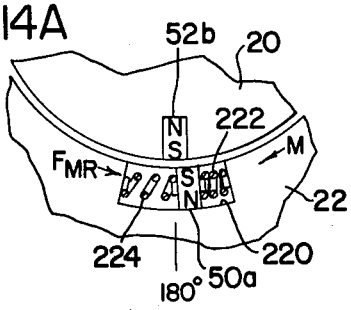
FIGS. 14A and 14B show schematically operating characteristics of the modification illustrated in FIG. 14.
Figure 14B:
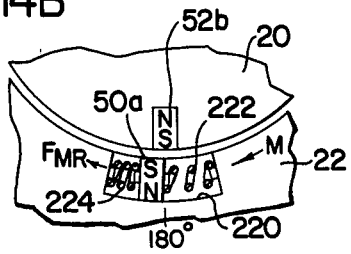

Referring now to FIG. 12, still further modification is illustrated. In this modification, permanent magnets 190, 192 are pivotally mounted within recesses 200, 202, respectively, of subwheel 20. Instead of the sub wheel 20 shifting position as illustrated in FIGS. 5A–5L, the individual magnets pivot against springs 204. Subwheel 20 is held stationary in the desired or selected position and springs 204 provide the snap action adjacent the 180° displacement mark, as described in connection with the preferred embodiment illustrated in FIG. 4. In this situation, subwheel 20 is the supporting means for holding the magnets 52*a*, 52*b* in a generally fixed position and movement of the magnets with respect to subwheel 20 is allowed. Since the magnets move separately and independently in FIG. 12, it is possible to employ only one shiftable permanent magnet to provide the over-center or snap action effect of the preferred embodiment of the invention. The other permanent magnet can be stationary with respect to generally fixed subwheel 20. A similar modification is illustrated in FIGS. 13, 13A, 13B. In this modification, a generally fixed subwheel 20 includes a recess 210 for mounting at least one permanent magnet 52*b*. This permanent magnet is centered by springs 212, 214. As subwheel 22 approaches the 180° displacement mark, as schematically illustrated in FIG. 31A, magnet 52*b* is shifted against the bias of spring 214. At about the 180° position, the magnetic forces become somewhat balanced in the direction of movement of magnet 52*b*. At this time, the spring action of spring 214 snaps the magnet 52*b* to the right. Thereafter, the repelling force between magnets 50*a*, 52*b* compresses spring 212, as shown in FIG. 13B. Of course, one or both magnets 52*a*, 52*b* could be mounted in this spring bias manner with respect to supporting subwheel 20. A similar arrangement could be provided when the spring biased magnets are provided in subwheel 22. Such a structure is schematically illustrated in FIGS. 14, 14A, and 14B. In this embodiment, a recess 220 is provided for at least magnet 50*a*. Springs 222, 224 center the magnet with respect to the recess. As subwheel 22 approaches the 180° displacement position, the magnet 52*a* is shifted against the bias of spring 222. As the magnetic forces become balanced adjacent the 180° position, magnet 50*a* snaps to the left and the repelling force between magnets 50*a*, 52*b*, shifts magnet 50*a* and compresses spring 224. This again provides a snap action adjacent the 180° position and stores spring energy to produce positive return to the reset, selected position for subwheel 22.

In the embodiment shown in FIGS. 12, 13 and 14, the magnets themselves are movable with respect to the structures used to secure the magnets in subwheels 20, 22. This movement is the same type of magnet movement as found in the other embodiments wherein the magnets 52*a*, 52*b* are moved with respect to spaced supporting or centering structures. In all instances the movable magnet or magnets move in a path generally arcuate of the given axis. The movement of the magnets in FIGS. 12, 13 and 14 produces the same action as a shifting subwheel 20.

As previously described, the magnets of subwheels 20, 22 can be ring shaped magnets such as ring shaped magnets 230, 232 shown in FIG. 15. Magnetic poles are provided on opposite semi-circular halves of the ring shaped magnets, and the magnets operate in accordance with the description of the preferred embodiment and illustrated modifications thereof. It is possible to provide a ring shaped permanently magnetizable material and provide selected magnetized areas without departing from the description and concepts of the present invention. When ring shaped magnets are used, they are generally formed in an injection molding operation from permanently magnetizable particles bound together by a plastic binding material, such as Nylon. The particles can be barium ferrite or Alnico, to name only two of the most common particles used in this type of molded permanent magnet.

A further modification of the preferred embodiment is illustrated in FIG. 16 wherein magnets 52*a*, 52*b* are secured onto subwheel 20. In this modification, subwheel 20 is provided with a recess 240 which defines a stop wall 242 and magnet 52*b* is allowed to shift from the position shown in FIG. 16 to an angularly offset position adjacent stop wall 242. Magnet 52*a* remains stationary with respect to subwheel 20. By allowing magnet 52*b* a slight amount of angular shifting, this magnet will react somewhat in accordance with the general description of magnet 52*b* in FIGS. 5B-G. As magnet 50*a* approaches the 180° position, magnet 52*b* is held firmly in the position shown in FIG. 16. Further movement of subwheel 22 in a clockwise direction causes a balancing of the magnetic forces between magnet 52*b* and magnet 50*b* to subwheel 22, which magnet is not shown in FIG. 16. Thereafter, slight movement beyond the balanced condition causes magnet 52*b* to snap into an angularly offset position against wall 242. As soon as the snap action takes place, a large moving force is created for returning number subwheel 22 to its home position in a clockwise direction. The floating or movable magnet 52*b* prevents a complete magnetic balance between the four magnets which create a magnetic return force at various positions adjacent the 180° displacement condition. As subwheel 22 again approaches the 180° position, magnet 52*b* is shifted into the position of FIG. 16. Fixed magnet 52*a* defines the return or home position. Recess 240 can allow movement of magnet 52*b* in both directions from the actual 180° position so that when magnets 52*b* and 50*a* are balanced, magnet 52*a* is generally receiving a reaction force.

Referring now to FIGS. 17, 17A and 17B, still a further modification of the preferred embodiment of the invention is illustrated. This modification is somewhat similar to the structure shown in FIG. 8, except the centering action and biasing action is created by two spaced magnets in a set wheel 110′. Wheel 110′ is formed from two relatively rotatable subwheels 250, 252, the first of which includes a hub 260, a bearing rim 262, at least two snap fingers 264, an arcuate recess 266 and a magnet 270 having an appropriately positioned, outwardly facing pole. Subwheel 252 includes a cylindrical recess 280 for rotatably receiving hub 260, a circumferentially extending groove 282 for receiving snap fingers 264 during assembly and a rotational movement limiting arm 284 having an axially extending tip 286. A magnet 290 oppositely poled with respect to magnet 250 is secured onto subwheel 252 so that this magnet is aligned and balanced by attraction with magnet 270 in the normal centered position of subwheels 250, 252. As shown in FIG. 17A, tip 286 extends into recess 266 to limit the angular movement between subwheels 250, 252 to approximately 3°–5° in either direction from the centered or 180° position determined by magnets 270, 290. As so far described, the magnets 270, 290 center the magnets of reset wheel 10 at the proper adjusted position and hold magnets 52*a*, 52*b* in their adjusted position determined by adjustment mechanism 40. When a reaction force is created on magnets 52*a*, 52*b* this reaction force reacts against the magnetic attraction forces between magnets 270, 290. When the reaction force exerted on subwheel 20 is sufficiently large, subwheel 250 carrying gear 32 is shifted with respect to subwheel 252. The amount of angular shift in either direction is limited by tip 286 which extends into recess 266. It is appreciated that this magnetic biasing mechanism for centering the magnets 52*a*, 52*b* acts substantially in accordance with the spring biased centering arrangement as previously discussed. Magnets 270, 290 return the subwheels 250, 252 to their adjusted, centered position when magnetic reaction forces on subwheel 20 release gear 32 through gear 30.

Having thus defined my invention, I claim:

1. In a device for rotating a member about a given axis to a selected angular position when said member is free to rotate from a position angularly spaced from said selected position, said device including a first set of permanent magnets, means for supporting said first set of magnets on said member, a second set of permanent magnets, means for supporting said second set of magnets in a generally fixed position to create a magnetic return force on said first set of magnets and a magnetic reaction force on said second set of magnets, said forces combining to return magnetically said member to said selected position when said member is spaced from said selected position and is free to rotate, the improvement comprising: shifting means for allowing a preselected amount of movement of at least one of said magnets in said first and second sets of magnets in response to one of said magnetic forces, said allowed movement being generally arcuate of said given axis and with respect to the supporting means of the magnet allowed to move.

2. The improvement as defined in claim 1 including means for holding said magnets of each of said sets in fixed relationship with each other.

3. The improvement as defined in claim 1 wherein said preselected amount is an angular distance of at least about 3° in at least one of two angular directions with respect to said given axis.

4. The improvement as defined in claim 1 wherein said preselected amount is an angular distance within the general range 3°–5° in at least one of two angular directions with respect to said given axis.

5. The improvement as defined in claim 1 wherein said shifting means includes a biasing means for resisting said preselected amount of movement.

6. The improvement as defined in claim 1 wherein said shifting means includes a first spring means for resisting movement of said at least one magnet in a first angular direction with respect to said axis and a second spring means for resisting movement of said at least one magnet in a second angular direction with respect to said given axis, said directions being opposing.

7. The improvment as defined in claim 4 wherein said preselected amount is an angular distance within the general range of 3°–5° in each of said two angular directions.

8. In a device for rotating a member about a given axis to a selected angular position when said member is free to rotate from a position angularly spaced from said selected position, said device including a first set of permanent magnets, means for supporting said first set of magnets on said member, a second set of permanent magnets, means for supporting said second set of magnets in a generally fixed position to create a magnetic return force on said first set of magnets and a magnetic reaction force on said second set of magnets, said forces combining to return magnetically said member to said selected position when said member is spaced from said selected position and is free to rotate, the improvement comprising: shifting means for allowing a preselected amount of movement of at least one of said first and second sets of magnets in response to one of said magnetic forces, said allowed movement being generally arcuate of said given axis and with respect to the supporting means of the magnet set allowed to mvoe.

9. The improvement as defined in claim 8 wherein said preselected amount is an angular distance of at least about 3° in at least one of two angular directions with respect to said given axis.

10. The improvement as defined in claim 8 wherein said preselected amount is an angular distance within the general range of 3°–5° in at least one of two angular directions with respect to said given axis.

11. The improvement as defined in claim 8 wherein said shifting means includes a biasing means for resisting said preselected amount of movement.

12. The improvement as defined in claim 8 wherein said shifting means includes a first spring means for resisting movement of said at least one magnet in a first angular direction with respect to said axis and a second spring means for resisting movement of said at least one magnet in a second angular direction with repsect to said given axis, said directions being opposing.

13. The improvement as defined in claim 8 wherein said support means for said second set of magnets includes a first gear rotatable about said given axis, means for fixing said first set of magnets on said first gear, a second gear meshed with said first gear and rotatable about a second axis spaced from and generally parallel to said given axis and means for fixing the general angular position of said second gear.

14. In a device as defined in claim 8 including means for adjusting the angular position of said second set of magnets about said given axis to change said selected angular position of said member.

15. The improvement as defined in claim 10 wherein said preselected amount is an angular distance within the general range of 3°–5° in each of said two angular directions.

16. The improvement as defined in claim 13 wherein said shifting means includes an angular motion allowing connection means between said second gear and said position fixing means for allowing controlled movement of said second gear with respect to said general angular position.

17. The improvement as defined in claim 13 wherein said shifting means includes a spring means for resisting said preselected amount of movement.

18. The improvement as defined in claim 13 wherein said shifting means includes a first spring means for resisting movement of said at least one magnet in a first angular direction with respect to said axis and a second spring means for resisting movement of said at least one magnet in a second angular direction with respect to said given axis, said directions being opposing.

19. The improvement as defined in claim 16 wherein said preselected amount is an angular distance within the general range of 3°–5° in at least one of two angular directions with respect to said given axis.

20. The improvement as defined in claim 16 wherein said shifting means includes a spring means for resisting said preselected amount of movement.

21. The improvement as defined in claim 19 wherein said preselected amount is an angular distance within the general range of 3°–5° in each of said two angular directions.

22. The improvement as defined in claim 14 wherein said preselected amount is an angular distance within the general range of 3°–5° in at least one of two angular directions with respect to said given axis.

23. The improvement as defined in claim 14 wherein said preselected amount is an angular distance within the general range of 3°–5° in each of said two angular directions.

24. The improvement as defined in claim 14 wherein said shifting means includes a spring means for resisting said preselected amount of movement.

25. The improvement as defined in claim 14 wherein said shifting means includes a first spring means for resisting movement of said at least one magnet in a first angular direction with respect to said axis and a second spring means for resisting movement of said at least one magnet in a second angular direction with respect to said given axis, said directions being opposing.

26. In a device for rotating a first member about a given axis to a selected angular position when said first member is free to rotate from a position angularly spaced from said selected position, said device including a second member rotatable about said given axis, a first permanent magnetic system carried by said first member, a second permanent magnetic system carried by said second member, said magnetic systems being unbalanced and creating magnetically induced torque reaction forces on said second member alternately in first and second angular directions when said first member is spaced from said selected position, and said magnetic systems being balanced magnetically when said first member is in said selected position and means for locating said second magnetic system in adjusted angular positions, the improvement comprising: torque responsive means for allowing a preselected amount of angular movement of said second member about said given axis when said second member is subjected to magnetically induced torque reaction force in at least said first direction and while said second magnetic system is located in an adjusted position.

27. The improvement as defined in claim 26 including means for changing said adjusted angular position of said second member about said given axis to change said preselected angular position of said first member.

28. The improvement as defined in claim 27 wherein said adjusting means includes a first gear connected to said second member and concentric with said given axis, a second gear meshed with said first gear and rotatable about a second axis spaced from and generally parallel to said given axis and rotating means for selectively rotating said second gear to a desired position and said torque responsive means includes an angular motion allowing connection means between said second gear and said rotating means for allowing controlled movement of said second gear with respect to said desired position.

29. The improvement as defined in claim 27 wherein said adjusting means includes a first gear connected to said second member and concentric with said given axis, a second gear meshed with said first gear and rotatable about a second axis spaced from and generally parallel to said given axis and rotating means for selectively rotating said second gear to a desired position and said torque responsive means including an angular motion allowing connection means between said first gear and said second member for allowing controlled movement of said second member with repsect to said first gear.

30. The improvement as defined in claim 27 wherein said adjusting means includes an indexing means for incremental shifting of said second member about said given axis and a manually reciprocating member for indexing said indexing means.

31. The improvement as defined in claim 28 wherein said connection means includes said spring means.

32. The improvement as defined in claim 29 wherein said connection means includes said spring means.

33. The improvement as defined in claim 30 wherein said torque responsive means is a biasing means between said indexing means and said manually reciprocating member.

* * * * *